US006924424B2

(12) United States Patent
Sueta, Jr. et al.

(10) Patent No.: US 6,924,424 B2
(45) Date of Patent: Aug. 2, 2005

(54) ILLUMINATED MUSICAL INSTRUMENT

(75) Inventors: Edward Sueta, Jr., Whippany, NJ (US); Julie Sueta Kaufmann, Bernardsville, NJ (US); Paul E. Kaufmann, Bernardsville, NJ (US)

(73) Assignee: Macie Publishing Company, Rockaway, NJ (US)

( * ) Notice: Subject to any disclaimer, the term of this patent is extended or adjusted under 35 U.S.C. 154(b) by 105 days.

(21) Appl. No.: 10/629,969

(22) Filed: Jul. 30, 2003

(65) Prior Publication Data

US 2005/0022652 A1 Feb. 3, 2005

(51) Int. Cl.[7] ..... A63J 17/00

(52) U.S. Cl. ..... 84/464 A; 84/464 R; 84/384; 84/380 R

(58) Field of Search ..... 84/464 A, 464 R, 84/384, 380 R

(56) References Cited

U.S. PATENT DOCUMENTS

| | | | | | |
|---|---|---|---|---|---|
| 3,854,370 | A | * | 12/1974 | Sapinski | 84/485 R |
| 4,392,408 | A | * | 7/1983 | Suzuki | 84/380 C |
| 4,685,373 | A | * | 8/1987 | Novo | 84/464 A |
| 5,107,743 | A | * | 4/1992 | Decker | 84/478 |
| 5,929,361 | A | * | 7/1999 | Tanaka | 84/742 |
| 6,225,544 | B1 | | 5/2001 | Sciortino | |

* cited by examiner

*Primary Examiner*—Shih-Yung Hsieh
(74) *Attorney, Agent, or Firm*—Lerner, David, Littenberg, Krumholz & Mentlik, LLP

(57) ABSTRACT

A wind instrument such as a recorder or a flute is disclosed. The wind instrument may include a body fabricated from a clear or translucent light-transmitting material, with or without color. The body includes a compartment and a light source retained within the compartment. The light source may direct light along and through the body of the wind instrument. The light source may include multiple colored LEDs or other light-emitting devices.

19 Claims, 3 Drawing Sheets

ILLUMINATED MUSICAL INSTRUMENT

FIELD OF THE INVENTION

This invention relates generally to musical instruments and more particularly to wind instruments such as recorders and flutes. More particularly, this invention relates to wind instruments that are made of translucent materials and have an associated light source.

BACKGROUND OF THE INVENTION

For many years, efforts have been made to create improved musical instruments. Despite such efforts, little change has occurred in the structure and operation of various wind instruments. For example, a recorder is a well-known type of wind instrument made from various materials such as wood, plastic and metal. It has a mouthpiece and an elongated body with air holes (i.e., apertures) that are selectively covered by a player's fingers during playing of the recorder. Music is produced from a recorder by blowing air through the mouthpiece and adjusting the pitch by covering one or more of the air holes.

Recorders are often used in the classroom setting for music education. The recorder is an optimal instrument for teaching students how to play music as its structure is simple and relatively easy for beginners to learn how to produce pleasant-sounding music in a relatively short period of time.

In order to promote additional interest in music, and in wind instruments such as recorders in particular, some efforts have been made to create improved products. For example, one desirable commercial recorder is sold under the trademark KINGSLEY by Macie Publishing Company of Rockaway, N.J. Various models of KINGSLEY recorders are available. Notwithstanding the differences between models of KINGSLEY recorders, a need still exists for an improved recorder structure.

Other parties have created recorders, flutes and various string instruments having an illumination source such as separately attachable light units or light-emitting diodes (LEDs). Examples of such products are disclosed in U.S. Pat. No. 4,685,373 to Novo; U.S. Pat. No. 6,225,344 to Sciortino; and U.S. Pat. No. 4,392,408 to Suzuki.

Notwithstanding the prior efforts to create desirable lighted instruments, a need still exists for an improved musical instrument, such as an improved recorder or the like, with a light source secured thereon to enhance playing of the instrument. Such an improved musical instrument will generate student enthusiasm, interest in music and the desire to learn, play and to practice playing on a new "cool" musical instrument. Further, a musical instrument with a light-emitting display will also provide an added interest in the playing of such instrument because it can incorporate into and enhance the performance of the musical selection being played, for example, use of a colored light display. Patriotic musical selections particularly lend themselves to the use of such lighting displays with the given patriotic musical selection. The present invention addresses such musical instruments with a light source for these objects and advantages.

SUMMARY OF THE INVENTION

Thus, in accordance with a first embodiment, the present invention comprises a wind instrument with an elongated body having first and second ends. A passageway is arranged within the body and extends longitudinally along at least a portion of the length thereof between the first and second ends. A mouthpiece is arranged at the first end of the elongated body and has an opening adapted to permit air to be blown therein such that the air will travel through at least part of the passageway. A plurality of apertures (air holes) are arranged along the elongated body and are open to the passageway. The apertures preferably have a central axis transversely arranged with respect to the central longitudinal axis of the passageway. Molded integrally with the elongated body is a compartment in which a light source is retained. The light source preferably transmits light through and longitudinally along the elongated body.

In a preferred embodiment, the elongated body is made of a translucent material. More preferably, the translucent material comprises a polymer, which may be clear or colored.

A power source, such as a battery, may be arranged within the compartment and is electrically connected to the light source for providing voltage and/or current thereto. The light source preferably comprises at least one light-emitting diode (LED), but may also comprise other light-emitting devices such as incandescent light bulbs or the like.

In an alternate embodiment, the light source may comprise a plurality of LEDs. In yet another alternate embodiment, the plurality of LEDs may comprise multiple colored LEDs adapted to transmit various colored light beams.

The illuminating attachment or assembly may also include a switch electrically connected in the circuit to the light source for permitting a user to selectively activate and deactivate the light source. The switch may be arranged partially within the compartment defined by the integrally formed illuminating attachment or assembly for the wind instrument and extend to the exterior of the illuminating assembly or attachment for access by the user playing such musical instrument with a light source.

Preferably, the elongated body comprises an upper side and lower side. At least some of the plurality of apertures are arranged at the upper side. The integral compartment in which the light source is retained may be arranged at the lower side such that the light source directs light longitudinally along the lower side of the elongated body. In a preferred embodiment, the light source directs light along the lower side of the elongated body in a direction away from the mouthpiece.

In the preferred embodiment where the elongated body is made of a translucent material, activation of the light source will preferably illuminate the entire elongated body itself as one or more light beams produced by the light source may be transmitted along through the translucent material of the body.

In the preferred embodiment where the compartment and associated light source are arranged at the lower side of the body of the musical instrument, the user may enjoy or achieve the desired illuminating effect when the light source is activated while avoiding the undesirable effect of light being directed into the eyes of a user during playing of the musical selection on the musical instrument.

Accordingly, it is an object of the present invention to provide a recorder or other improved wind instrument with an associated light source arranged within the body of the instrument such that a desired visual effect may be selectively obtained while the instrument is being played to create musical sounds or a musical composition.

It is another aspect of the present invention to provide a musical instrument with an internal light assembly such that a coacting light display may be selectively obtained to enhance the musical sounds or selection being played on the musical instrument.

These and other objects and advantages of the present invention will be better understood when reference is made to the following detailed description below when taken in connection with the accompanying drawings in which:

DETAILED DESCRIPTION

Figure 1:
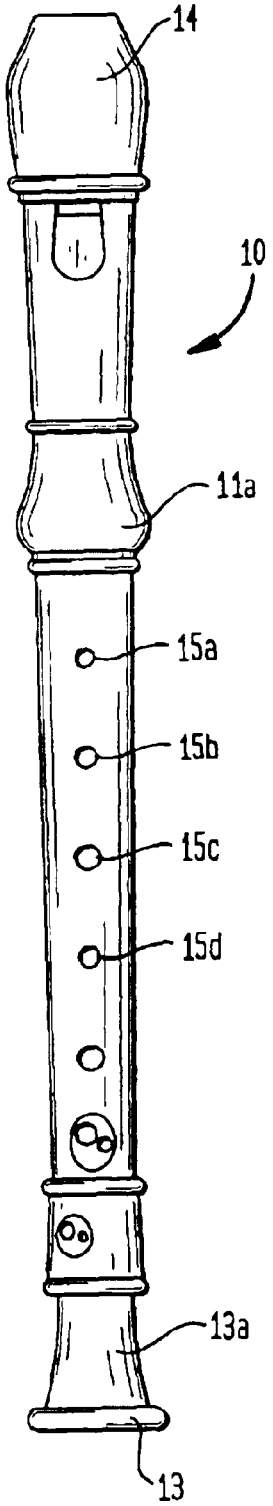
FIG. 1 is a front or top view of a musical instrument, namely a recorder in accordance with the present invention.

The present invention is directed to a musical instrument such as a recorder generally designated 10 and shown in the figures of the drawings. While the illustration of the present invention is shown with respect to a recorder, those skilled in the art will recognize that this instrument is used only for purposes of illustration and that the invention is equally applicable to other wind instruments such as flutes and the like which have bodies made of materials which are light-transmitting (i.e., translucent). Therefore, the illustrated embodiment is not by way of limitation of the scope of the present invention.

Recorder 10 has a generally elongated body 11 with an elongated passageway 12 extending along the longitudinal length thereof. The longitudinally extending passageway 12 is open to permit airflow during playing of the recorder 10 between a first end at mouthpiece 14 and a second end opening 13 remote from the mouthpiece 14. The body 11 is preferably shaped to provide a bulbous portion as at 11*a* to aid in the diffusion of light when the musical instrument such as the recorder 10 is illuminated.

Along the body 11 of recorder 10, a plurality of apertures 15*a*, 15*b*, 15*c*, 15*d*, etc. communicate with the elongated passageway 12. Mouthpiece 14 is formed having an inlet opening 16 which communicates with the elongated passageway 12. In operation a user or player of the recorder blows and forces air through the inlet opening 16 in the mouthpiece 14 which air flows through the elongated passageway 12 and will be allowed to escape through one or more of the apertures 15*a*, 15*b*, 15*c*, 15*d*, by finger or lever operation, not shown, for covering and uncovering these apertures to produce the desired musical tones and sounds for the music being played. Any excess air will escape through the end opening 13 in the second end remote from the mouthpiece 14 identified by bell-shaped outlet as at 13*a*. The structure, operation and use of recorders as above described are well known to those skilled in the musical art and accordingly will not be more fully described.

An important characteristic of the musical instrument or recorder 10 in accordance with the present invention is that the body 11 will be molded, formed or fabricated from natural or synthetic materials which are translucent (colorless or colored) such that the material used is light-transmitting when light is directed in, along and/or through the body 11 of the recorder 10. As used herein, the term "along" should be construed in accordance with its ordinary meaning and also is intended to cover light that is transmitted within, along or through the body 11. Thus, the translucent body 11 enables light to diffuse and spread so that it may illuminate the entire body from the point where the light is introduced thereon or therein. Materials which can be used for fabricating the recorder to achieve this function or purpose are well known in the art and may include, but are not limited to, various preferred polymeric materials.

Figure 2:
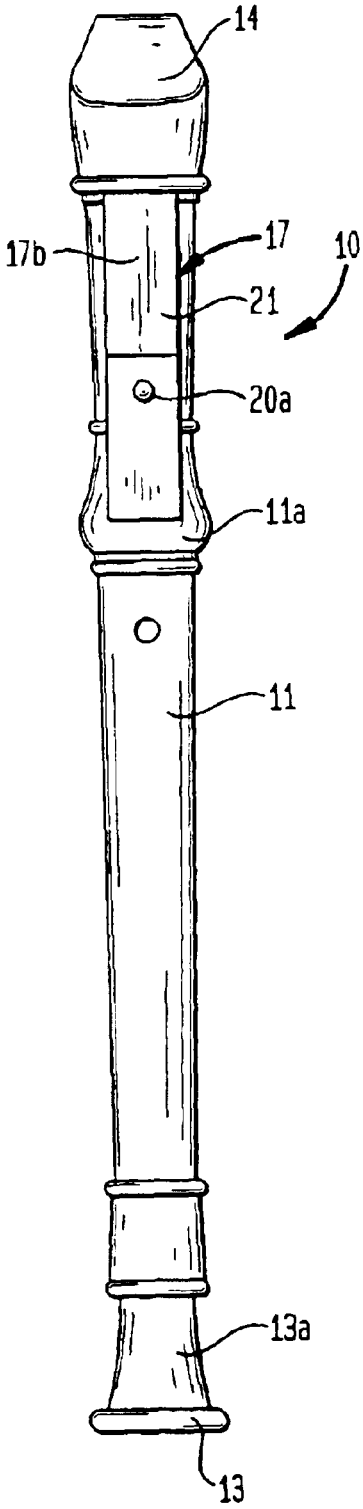
FIG. 2 is a back or bottom view of the recorder shown in FIG. 1 showing the light assembly arranged on the body of the recorder.
Figure 3:
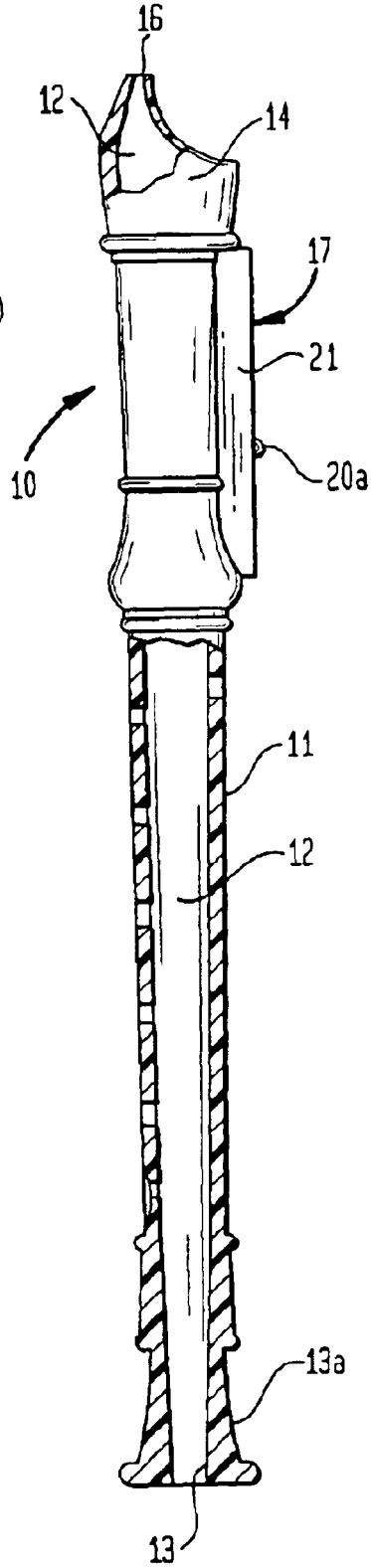
FIG. 3 is a side view of the recorder shown in FIGS. 1 and 2 partly in vertical section.
Figure 4:
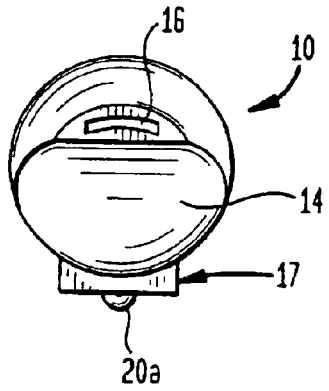
FIG. 4 is an end view of the mouthpiece end of the recorder shown in FIGS. 1, 2 and 3.
Figure 5:
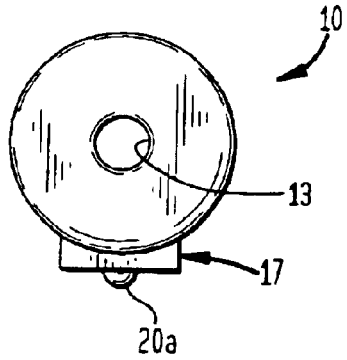
FIG. 5 is an end view of the shell or outlet end for operating air for the recorder shown in FIGS. 1, 2 and 3.

The translucent material from which the recorder 10 is fabricated enables it to be molded, formed or fabricated with a self-sustaining light assembly or assembly as at 17. Light assembly 17 is arranged within a compartment 17*a* and is preferably formed on the body 11 on the underside thereof so that it is spaced from the outlets 15*a*, 15*b*, 15*c*, 15*d* at the top side and does not interfere with the positioning of the fingers of the operator using and playing the recorder 10 and is easily accessible to place the light assembly 17 into operation, all of which is shown in FIGS. 1, 2 and 3.

Figure 6:
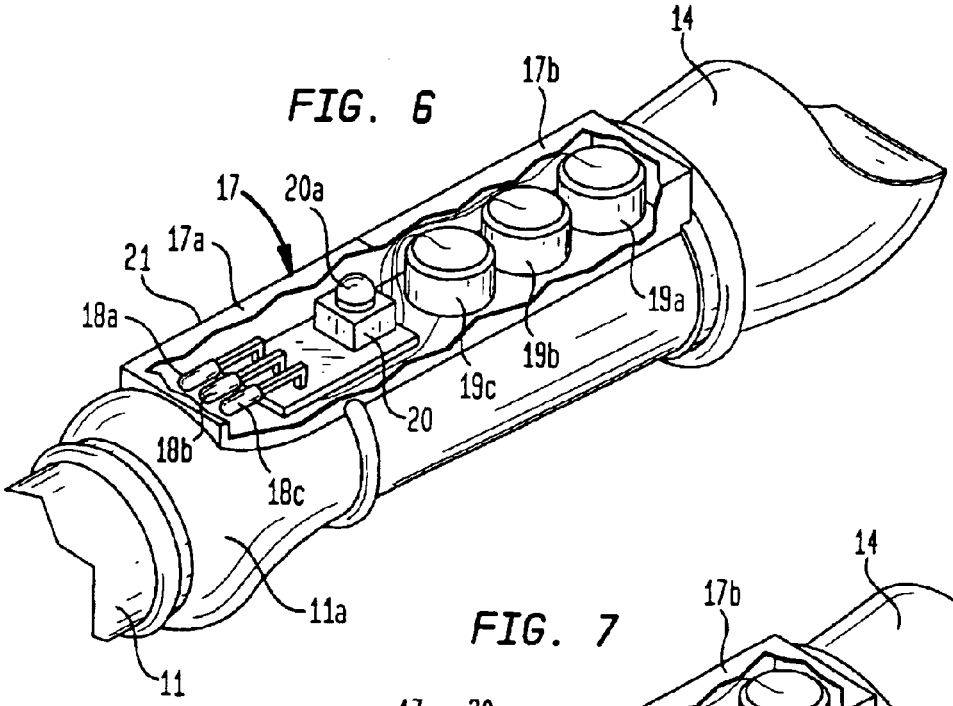
FIG. 6 is an enlarged perspective view of the portion of the recorder showing one embodiment for the integral illuminating attachment as shown in FIG. 1 partly in vertical section to show one form of the lighting device, the power source and the control switch for operating the illuminating attachment.

The light assembly 17 and the associated compartment 17*a* is a generally open elongated rectangular box-like storage space which can be maintained closed by a removably mounted cover 17*b*. The cover can be connected as by a threaded member, not shown, hinged or by slidable guides, also not shown, as is well known in the art to provide access to compartment 17*a* for changing and replacing the elements of the light assembly 17, as shown in FIGS. 2 and 6.

Light assembly 17 is self-sustaining in the sense that the compartment 17*a* holds the various elements to be connected into position for illuminating the musical instrument or recorder 10. Thus, mounted in the compartment 17*a* is at least one and preferably a plurality of LEDs 18*a*, 18*b* and 18*c*, a power source such as batteries 19*a*, 19*b* and 19*c* for operating the light-emitting members, and a switch 20 having a switch operating button 20*a* which extends to the exterior of the compartment 17*a* when it is closed by the cover 17*b*. The switch 20 is connected to and is used for operating the LEDs 18*a*, 18*b* and 18*c* when it is desired to illuminate recorder 10 to achieve the advantageous results of the present invention.

While the light assembly 17, compartment 17*a* and cover 17*b* are shown as rectangular, those skilled in the art will recognize that this shape is only for purposes of illustrating the present invention and that the light assembly 17 and associated compartment 17*a* may have many other shapes depending on the instrument in which it is being used. Further, while the compartment 17*a* is shown as preferably integrally molded, those skilled in the art will readily recognize that the light assembly 17 can be arranged within a separately molded or formed housing and so affixed that it will form an integral part of the recorder 10 to achieve the same purposes and objects without departing from the scope of the present invention of the illuminating attachment as above described.

Light assembly 17 and the associated compartment 17*a* are also sized and shaped so that they will be large enough to provide space for the battery unit or units as at 19*a*, 19*b* and 19*c*, the at least one or preferably more LEDs as at 18*a*, 18*b* and 18*c* or an incandescent or other light unit or units, as the case may be, and the switch 20 for placing the light assembly 17 into operation. The battery or batteries will have sufficient power to operate the light source, such as LEDs 18*a*, 18*b* and 18*c*, for a reasonable period of time. Switch 20 can be any type of manually operated switch such as a push button type switch, which is normally open in the off position.

Further, one end wall 21 of the light assembly 17 and compartment 17*a* is disposed to project or face the bell-shaped end 13 of the frame 11 so that the LEDs 18*a*, 18*b* and 18*c* communicate with the bulbous portion 11*a* of the body 11 to enable the transmitted light to diffuse and pass in and through the body 11 of the recorder 10 to illuminate the entire instrument and create the desired lighting effect, as is shown in the embodiment of the present invention at FIG. 6.

Figure 7:
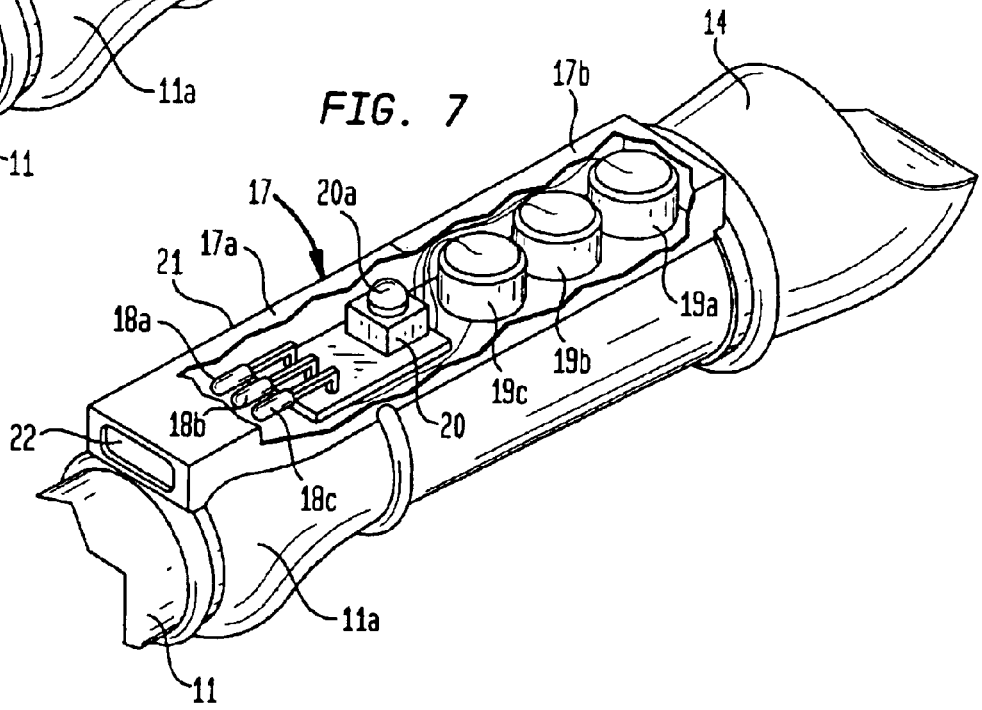
FIG. 7 is an enlarged perspective view of the portion of the recorder showing another embodiment for the light source as shown in FIG. 1 partly in vertical section showing the same form of lighting device shown in FIG. 6, the power source and the control switch for operating the light source.

In an alternate embodiment of the present invention shown in FIG. 7 where the same parts have the same character numerals, the end wall 21 of the light assembly 17 may also have an opening or window 22 to enable the light emitted or generated when the LEDs 18*a*, 18*b* and 18*c*, in the compartment 17*a* are activated or in the on position to project, communicate or be directed to diffuse on, into, along and through the translucent material of body 11. In this regard, the opening 22 can be shaped and sized to provide the optimum projection and communication of the emitted light with the material of the body 11 to allow the entire recorder 10 to be illuminated in accordance with the object and purposes of the present invention.

Figure 8:
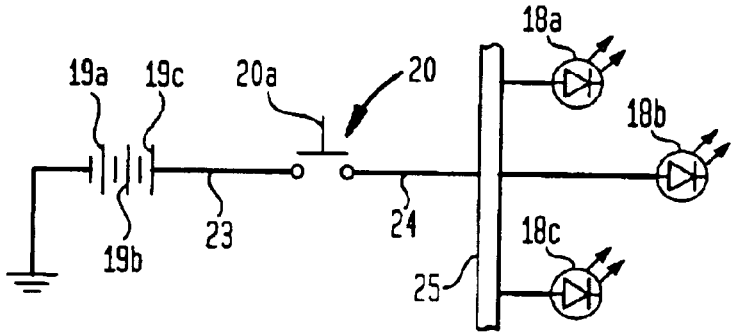
FIG. 8 is a schematic drawing of the circuitry including the lighting device, the power source and the control switch for operating the self-sustaining light source shown in FIGS. 1, 2, 3, 6 and 7.

FIG. 8 shows that the electronic circuitry for the light assembly 17 is relatively basic or conventional. Thus, the battery power source at 19*a*, 19*b* and 19*c* are connected by current carrying line 23 to one side of the normally open switch 20. The other opposite side of switch 20 is connected by current carrying line 24 to a bus bar 25 to which the LEDs 18*a*, 18*b* and 18*c* are in turn connected, to complete the circuit. The LEDs 18*a*, 18*b* and 18*c* are so positioned in the light assembly 17 so that when the switch 20 is moved manually to the closed or on position, the light beams emitted by the LEDs 18*a*, 18*b* and 18*c* will be directed as shown in FIG. 6 into and through the bulbous section 11*a* of the translucent material of the body 11 and communicate or diffuse through the adjacent translucent material of the body 11 and thus illuminate the entire body 11 of the recorder 10 on which the light assembly 17 and its associated compartment 17*a* are formed, fabricated, molded or affixed to obtain the advantageous illuminating effects on the recorder 10.

In the alternative embodiment shown in FIG. 7, when the light-emitting members of the light assembly 17 are placed in the on position, the light in part can be projected along and over the body 11 as well as communicating with the translucent material to project and diffuse the light through the translucent material from which the body 11 is made to achieve the objects and purposes of the present invention.

Batteries, switches and LEDs are all well-known and conventional devices which will not be more fully described in connection with the present invention. Further, while LEDs are illustrated and preferred, because of their size and the limited power needed for their operation, those skilled in the art will recognize that other light units may also be used without departing from the scope of the present invention.

In operation, either before the recorder with the light assembly 17 and compartment 17*a* and the associated light source therein is played or operated, or while the recorder 10 is being played or operated, when the switch 20 is moved to the on position, current flows through line 23, switch 20 and line 24 to the bus bar 25 and activates the LEDs 18*a*, 18*b* and 18*c* to transmit the light needed for illuminating the recorder 10. This light is projected, communicates or is directed in, on and diffuses through the translucent material of which the body 11 of the recorder 10 is made to provide a desirable visual effect.

Figure 9:
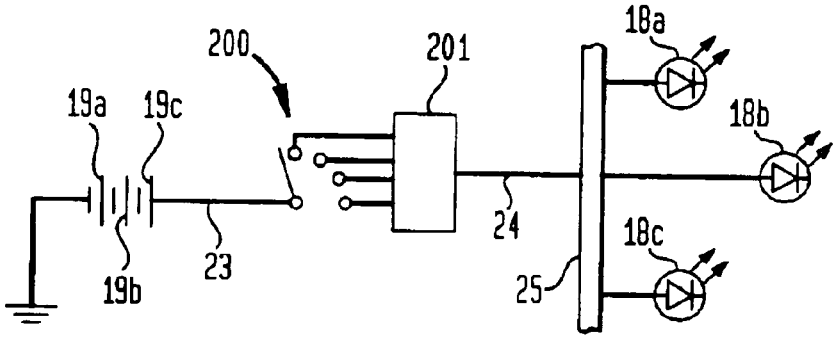
FIG. 9 is another schematic drawing for the circuitry of the self-sustaining light source including multiple LEDs, with a multi-position control switch and operatively associated electronic controller to provide various types of illumination.

FIG. 9 shows a modified form of the electronic circuitry for the light assembly 17 in which a normally open multiple position switch 200 is disposed for operative association with an electronic control unit 201. By selecting one of the multiple on positions of the switch 200, the electronic control unit 201 will provide varying cycles to cause the LEDs to flash on and off in a given sequence. The LEDs can have different colors and thus vary the nature of the light projected, communicating or directed in, on and diffusing through the material of which the body 11 of the recorder 10 is made to produce an even more unusual effect than can be obtained with colorless illumination. Patriotic music lends itself particularly to varying forms of combined colored and colorless light displays in association with the musical selection being played.

Thus, an illuminated musical instrument has been described having a body with a light assembly for providing, projecting and communicating a light source for illuminating the musical instrument.

Although the invention herein has been described with reference to particular embodiments, it will be understood that these embodiments are merely illustrative of the principles and applications of the present invention. It is therefore to be understood that numerous modifications may be made to the illustrated embodiments and that other arrangements may be devised without departing from the spirit and scope of the present invention as defined by the appended claims.

What is claimed is:

1. A wind instrument comprising:

an elongated body having first and second ends, said elongated body including a passageway therein extending longitudinally along at least a portion of the length thereof between said first and second ends, a mouthpiece arranged at said first end of said elongated body and having an opening to permit air to be blown thereon such that the air will travel through at least part of said passageway, a plurality of apertures arranged along said elongated body and opening to said passageway, said elongated body including an upper side and a lower side, at least some of said plurality of apertures arranged at said upper side, said elongated body defining a compartment arranged at said lower side, and a light source mounted in said compartment operable to transmit light longitudinally along said lower side of said elongated body.

2. In the wind instrument of claim 1 wherein the light source is disposed to transmit light through said elongated body.

3. In the wind instrument of claim 2 wherein said elongated body comprises a translucent material.

4. The wind instrument of claims 2 wherein said light source comprises at least one light-emitting diode (LED).

5. The wind instrument of claim 4 wherein said light source comprises a plurality of LEDs.

6. The wind instrument of claim 5 wherein said plurality of LEDs comprise multiple colored LEDs.

7. The wind instrument of claim 1 further comprising a switch electrically connected to said light source for permitting a user to selectively activate and deactivate said light source.

8. The wind instrument of claim 1 wherein said compartment and said light source are arranged at said second end of said elongated body.

9. A musical instrument comprising:

a. a body made of translucent material and having means for operating the instrument thereon, said body having an upper side and a lower side, and including a compartment integrally affixed thereon at said lower side; and b. a light assembly arranged within the compartment, said light assembly having at least one light-emitting device disposed to provide a light beam longitudinally along said lower side of body, a power source electrically connected to said at least one light-emitting device, and a switch for actuating the at least one light-emitting device between on and off states.

10. The musical instrument of claim 9 wherein said body comprises a polymeric material.

11. The musical instrument of claim 10 wherein said translucent material comprises plastic.

12. The musical instrument of claim 9 wherein said translucent material of said body comprises natural or synthetic materials.

13. The musical instrument of claim 9 wherein said light-emitting device comprises at least one incandescent light source.

14. The musical instrument of claim 9 wherein said light-emitting device comprises at least one LED.

15. The musical instrument of claim 9 wherein said light-emitting device comprises a plurality of LEDs operative to transmit a plurality of colored and colorless light beams.

16. A musical instrument comprising:

a. a body made of translucent material and having a mouthpiece and a plurality of apertures thereon for operating the instrument, said body having an upper side and a lower side, and including a compartment integrally formed at said lower side thereon; and b. a light assembly arranged within the integral compartment, said light assembly having a plurality of light-emitting devices disposed to direct light longitudinally along said lower side of said body, a power source for the light-emitting device, and a switch for actuating said plurality of light-emitting devices between on and off states.

17. The musical instrument of claim 16 comprising electronic circuitry electrically connected to said switch for automatically activating and deactivating said plurality of light-emitting devices into on and off states.

18. The musical instrument of claim 17 wherein said body comprises a polymeric material.

19. The musical instrument of claim 18 wherein said light-emitting devices comprise a plurality of LEDs.

* * * * *